US006598912B2

(12) United States Patent
Hillgaertner et al.

(10) Patent No.: US 6,598,912 B2
(45) Date of Patent: Jul. 29, 2003

(54) ACTUATING DEVICE FOR A HOOD OF A MOTOR VEHICLE

(75) Inventors: Klaus Hillgaertner, Wurmberg (DE); Michael Hubmann, Bad Rappenau (DE)

(73) Assignee: Dr. Ing. h.c.F. Porsche Aktiengesellschaft, Stuttgart (DE)

( * ) Notice: Subject to any disclaimer, the term of this patent is extended or adjusted under 35 U.S.C. 154(b) by 0 days.

(21) Appl. No.: 10/067,375

(22) Filed: Feb. 7, 2002

(65) Prior Publication Data

US 2002/0104400 A1 Aug. 8, 2002

(30) Foreign Application Priority Data

Feb. 7, 2001 (DE) ..... 100 05 541

(51) Int. Cl.[7] ..... E05C 3/16

(52) U.S. Cl. ..... 292/225; 292/336.3; 292/DIG. 14; 292/DIG. 43; 74/501.6

(58) Field of Search ..... 292/225, 336.3, 292/DIG. 14, DIG. 43, 125, 28, 38, 50, 84, 133, 141, 235; 74/500.5, 501.6, 502.2, 527, 532, 535, 536, 537; 16/408, 421

(56) References Cited

U.S. PATENT DOCUMENTS 3,831,409 A 8/1974 Gebhard et al.
4,266,816 A * 5/1981 Mukai et al. ..... 292/129
4,374,597 A 2/1983 Mochida
4,616,862 A * 10/1986 Ward ..... 292/201
4,752,092 A * 6/1988 Faust ..... 292/336.3
4,889,373 A * 12/1989 Ward et al. ..... 292/336.3
4,991,884 A * 2/1991 Cairns ..... 292/28
5,039,145 A * 8/1991 Frye ..... 292/336.3
5,535,608 A * 7/1996 Brin ..... 238/127
5,681,068 A * 10/1997 Kleefeldt et al. ..... 292/336.3
5,826,672 A * 10/1998 Holter et al. ..... 70/241
5,853,060 A * 12/1998 Chao et al. ..... 180/69.2
5,961,166 A * 10/1999 Edwards ..... 292/336.3
6,240,804 B1 * 6/2001 Gabas Cebollero ..... 292/8
2002/0047279 A1 * 4/2002 Byrla et al. ..... 292/336.3

FOREIGN PATENT DOCUMENTS

DE 3717485 A 1 12/1987
DE 29922605 U1 6/2000

* cited by examiner

*Primary Examiner*—J. J. Swann
*Assistant Examiner*—Matthew E. Rodgers
(74) *Attorney, Agent, or Firm*—Crowell & Moring LLP

(57) ABSTRACT

The actuating device for a hood should be designed in such a way that an actuation from the outside for misuse is not possible. For this purpose, the actuating device is equipped with a handle, in which a locking sensing device and a catch element, which is connected with a Bowden cable, are arranged. By pressing the locking sensing device in the direction of the catch element is created a rigid connection between the locking sensing device and the catch element. For this purpose, the actuating sensing device is equipped with a catch nose and the catch element with a catch recess.

13 Claims, 1 Drawing Sheet

ACTUATING DEVICE FOR A HOOD OF A MOTOR VEHICLE

BACKGROUND AND SUMMARY OF THE INVENTION

This application claims the priority of German Patent Document No. 101 05 541.2, filed Feb. 7, 2001, the disclosure of which is expressly incorporated by reference herein.

The invention relates to an actuating device for a hood of a motor vehicle.

DE 37 17 485 A1 discloses a locking arrangement for a front hood of a motor vehicle with a locking member that can swivel between a locking position and a release position. It includes an operating lever, connected to a swiveling lever and having a locking nose, which meshes with a catch recess in the locking position. In the release position, the swiveling lever is unlocked through a remote control, and the operating lever can swivel out of the catch groove.

An object of the invention is to create an actuating device for a hood of a motor vehicle, which prevents the opening of the hood by reaching into the actuating device from the outside.

The object of the invention is achieved with the devices and methods of the present invention.

In accordance with one aspect of the present invention, the benefits of the invention include that an additional locking device is incorporated into the handle for opening the hood, wherein this sensing device has to be pushed by an operator to open the hood.

To that end, the handle includes an integrated locking device, which is arranged in the handle in a swiveling manner and is held in a locking position through a spring device. The locking device is located opposite a catch element, which can mesh with the locking device in an actuating position.

Although it is possible to swivel the handle from outside the vehicle, the locking device cannot mesh easily from the outside with the catch element to form a rigid connection between the handle and the Bowden cable when the device's nose on its free end is not engaged with a catch recess in the actuating position. This prevents an unauthorized actuation of the handle for the purpose of opening the hood from the outside.

In order to prevent an actuation of the locking device for misuse, the locking device is seated flush with the outer surface of the handle when the hood is in the locking position. Additionally, the locking device rests agaipst a stop and is held in by a support device with a spring.

The locking device includes an elongated lever with a swiveling axis in the handle. The catch element is formed by a lever with a seating part. The lever is adjustable on a swiveling axis in the handle and is connected at its free end with the Bowden cable. The catch recess is arranged in a seating part that is mounted to the swiveling axis. The actuating device with the locking device and the catch element is formed by parts that can be manufactured and assembled easily and are arranged in the handle on the swiveling axes.

An example of the invention is shown in the drawings and is described in more detail in the following.

DETAILED DESCRIPTION OF THE DRAWINGS

Figure 3:
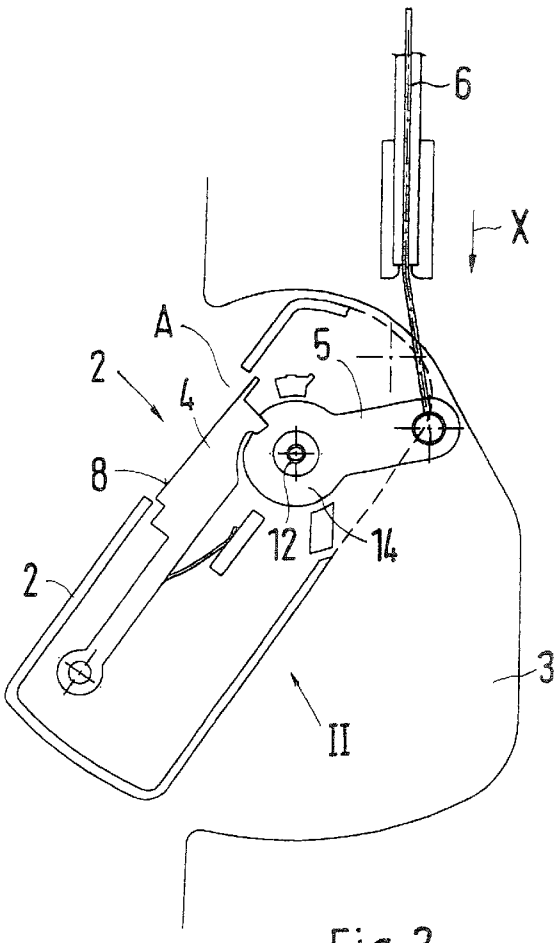
FIG. 3 is a view of the handle in the actuating position with the locking device meshed with the catch element.

The actuating device 1 comprises basically a handle 2, which is arranged in a trough 3, for example in the A-column, in the interior of the vehicle. This handle 2 is 1ased to open a hood or the like. In the handle 2, a locking device 4 and a catch element 5 are arranged. The catch element 5 is connected with a Bowden cable 6, which leads to the hood lock.

Figure 2:
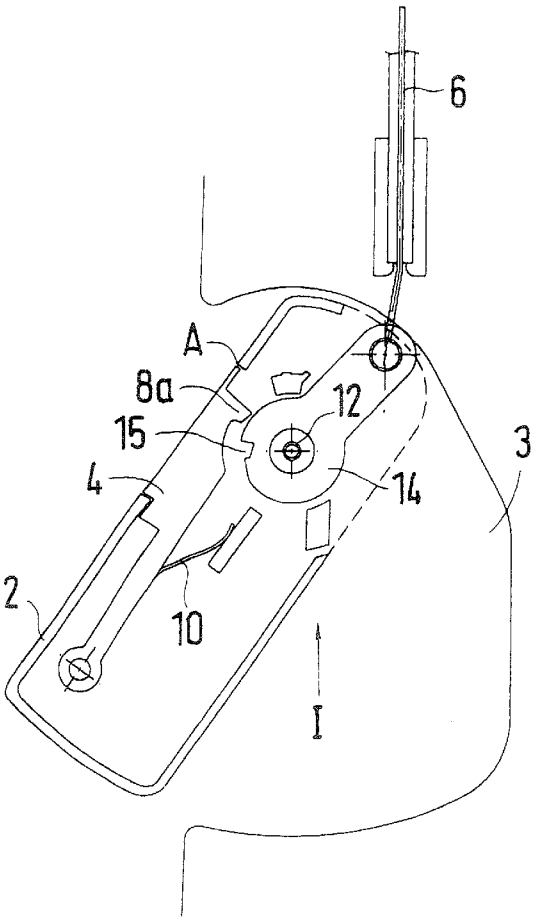
FIG. 2 is a view of the swiveled handle in the locking position of the hood.
Figure 1:
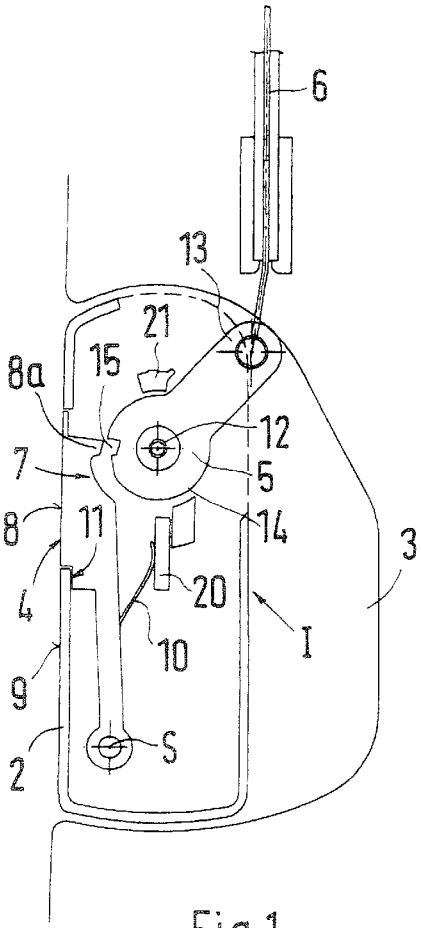
FIG. 1 a yiew of an actuating device with a locking device and a catch element arranged in a handle in a locking position for the hood of a vehicle.

The locking device 4 does not mesh with the catch element 5 in the locking position I of the hood, as shown in FIGS. 1 and 2. In an actuating position II, the locking device 4 meshes with the catch element 5, as shown in FIG. 3, and thus the hood can be opened.

The locking device 4 includes an elongated lever, and one end of the locking device 4 is held in a swiveling manner in a seat 5. The free end 7 in the handle 2 has an outer pressing surface 8 with an interior catch nose 8*a*. This pressing surface 8 is seated in a section A of the handle and runs flush with the outer surface 9 of the handle 2. The locking device 4 is held in a flush position in the section A of the handle with a spring device 10, such as a leaf spring, as shown in FIG. 1. The spring device 10 rests against the stop 20. The pressing surface 8 or the locking device 4 is supported in the handle 2 by a support device 11. The support device 11 include a protrusion on the locking device 4, which protrusion reaches under a rim of the handle 2.

The catch element 5 includes a lever, which can be adjusted on a swiveling axis 12 in the handle 2. On the free end 13 of the lever, the Bowden cable 6 is fastened. A catch recess 15 is arranged in a seating part 14, which surrounds the swiveling axis 12. This recess 15 meshes with the catch nose 8 of the locking device 4.

As shown in FIG. 1, the handle 2 is completely disposed in the trough 3, and the catch nose 8*a* does not mesh with the catch recess 15. As shown in FIG. 2, the hood cannot be opened and/or the Bowden cable 6 cannot be pulled by swiveling handle 2 because the catch nose 8*a*does not mesh with the locking device 4. In this way the hood cannot be opened from the outside and misuse is prevented.

By pressing the pressing surface 8 of the locking device 4 in the direction of the arrow Z in a position of the handle 2 in the trough 3 pursuant to FIG. 1, the nose 8*a* meshes with the catch recess 15. The Bowden cable 6 is pulled in the direction of the arrow X by swiveling the handle 2 out so that the hood lock can be unlocked. After releasing the locking device 4, the hood lock can be locked again by allowing the catch element 5 to assume its basic position pursuant to FIG. 1. This position is supported at the stop 21.

What is claimed is:

1. An actuating device for a hood of a motor vehicle, the hood having a rocking mechanism, the device comprising:

a catch element connected to the locking mechanism using a cable;

a handle; and an integrated locking device having a pressing surface, wherein the integrated locking device includes a locking position where the integrated locking device is disengaged with the catch element, and an actuating position where the integrated locking device is engaged with the catch element, wherein when the integrated locking device is in the locking position, the handle cannot be used to move the catch element to unlock the hood, and wherein when the integrated locking device is in the actuating position, the handle can be used to move the catch element to unlock the hood, and a spring device biasing the integrated locking device towards the locking position, wherein in order to use the handle to unlock the hood, the pressing surface of the locking device must be pressed to place the locking device in the actuating position.

2. The actuating device according to claim 1, wherein the integrated locking device has a nose, and the catch element has a catch recess, wherein when the integrated locking device is in the actuating position, the nose meshes with the catch recess to engage the integrated locking device with the catch element, and wherein when the integrated locking device is in the locking position, the nose does not mesh with the catch recess to disengage the integrated locking device with the catch element.

3. The actuating device according to claim 2, wherein in the locking position the integrated locking device is arranged flush with an outer surface of the handle.

4. The actuating device according to claim 2, wherein the handle having a support structure, and wherein the integrated locking device is held in the support structure by the spring device, when the integrated locking device is in the locking position.

5. The actuating device according to claim 2, wherein the integrated locking device includes an elongated lever that can swivel about an axis in the handle.

6. The actuating device according to claim 2, wherein the catch element includes a lever having a seating part and a free end, the catch recess being positioned at the seating part, and wherein the seating part of the lever is rotatably mounted to the handle at an axis so that the lever can swivel about the axis, and the free end of the lever is connected to the cable.

7. The actuating device according to claim 6, wherein the lever of the catch element rests against a stop of the handle in the locking position.

8. The actuating device according to claim 1, wherein in the locking position the integrated locking device is arranged flush with an outer surface of the handle.

9. The actuating device according to claim 1, wherein the handle having a support structure, and wherein the integrated locking device is held in the support structure by the spring device, when the integrated locking device is in the locking position.

10. The actuating device according to claim 1, wherein the integrated locking device includes an elongated lever that can swivel about an axis in the handle.

11. The actuating device according to claim 1, wherein the catch element includes a lever having a seating part and a free end, the catch recess being positioned at the seating part, and wherein the seating part of the lever is rotatably mounted to the handle at an axis so that the lever can swivel about the axis, and the free end of the lever is connected to the cable.

12. The actuating device according to claim 11, wherein the lever of the catch element rests against a stop of the handle in the locking position.

13. A method for unlocking a hood of a motor vehicle using an actuating device, the hood having a locking mechanism, the device including a catch element connected to the locking mechanism using a cable, a handle and an locking device integrated with the handle, the integrated locking device having a pressing surface, wherein the locking device includes a locking position where the integrated locking device is disengaged with the catch element, and an actuating position where the integrated locking device is engaged with the catch element, wherein when the integrated locking device is in the locking position, the handle cannot be used to move the catch element to unlock the hood, and wherein when the integrated locking device is in the actuating position, the handle can be used to move the catch element to unlock the hood, the method comprising:

pressing the pressing surface of the integrated locking device to place the integrated locking device in the actuating position so that the integrated locking device is engaged with the catch element; and turning the handle to unlock the hood.

* * * * *